US007156688B2

(12) United States Patent
Nakano et al.

(10) Patent No.: US 7,156,688 B2
(45) Date of Patent: Jan. 2, 2007

(54) INSULATION DISPLACEMENT CONNECTOR

(75) Inventors: Tomohiro Nakano, Fujisawa (JP); Toshiya Oda, Yamoto (JP); Norio Yoshida, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/517,360

(22) PCT Filed: May 30, 2003

(86) PCT No.: PCT/US03/17045

§ 371 (c)(1),
(2), (4) Date: Jun. 23, 2005

(87) PCT Pub. No.: WO03/103093

PCT Pub. Date: Dec. 11, 2003

(65) Prior Publication Data

US 2005/0250373 A1 Nov. 10, 2005

(30) Foreign Application Priority Data

May 31, 2002 (JP) ..... 2002-160194
Feb. 19, 2003 (JP) ..... 2003-040702

(51) Int. Cl.
*H01R 11/20* (2006.01)

(52) U.S. Cl. ..... 439/417

(58) Field of Classification Search ..... 439/417, 439/499, 404, 405

See application file for complete search history.

(56) References Cited

U.S. PATENT DOCUMENTS 3,958,852 A * 5/1976 Abraham et al. ..... 439/355
4,372,634 A * 2/1983 Ritchie et al. ..... 439/55
4,678,264 A * 7/1987 Bowen et al. ..... 385/89
5,188,541 A * 2/1993 Comerci et al. ..... 439/596
5,362,253 A * 11/1994 Lin et al. ..... 439/462
5,562,480 A * 10/1996 Drewanz et al. ..... 439/404
5,664,963 A * 9/1997 Yamamoto et al. ..... 439/409
6,062,896 A * 5/2000 Huang ..... 439/405
6,273,745 B1 * 8/2001 Yeh ..... 439/404
6,464,532 B1 * 10/2002 L'Abbate et al. ..... 439/467

FOREIGN PATENT DOCUMENTS

JP 09-153380 * 10/1997

* cited by examiner

*Primary Examiner*—Tulsidas C. Patel
*Assistant Examiner*—Phuongchi Nguyen
(74) *Attorney, Agent, or Firm*—Thomas D. Paulius

(57) ABSTRACT

An IDT connector (1) is provided which includes: a base housing (3) having a terminal (19) to which a wire (21) is press-fit; a cover housing (5) mounted to the base housing (3) and having a wire insertion hole (29) into which the wire (21) is inserted; a wire holder (31) which is provided to the cover housing, for pressing the wire that is to be press-fitted to the terminal; and an IDT contact slot extending orthogonal to the wire insertion hole and formed adjacent to the wire holder with respect to the longitudinal direction of the wire insertion hole.

5 Claims, 21 Drawing Sheets

INSULATION DISPLACEMENT CONNECTOR

BACKGROUND OF THE INVENTION

The present invention relates generally to a connector used for connecting insulated electric wires to various electrical parts or a printed circuit board, or for interconnecting a plurality set of electrical wires.

A connector with Insulation Displacement Technology Connection ("IDT") has been widely used for making a permanent electrical interface between a wire and a contact of a connector. In this method, insulated wires are forced into a slot smaller in width than the diameter of the inner conductor of the wire. The sharp thin edges of the slot displace the outer insulation and electrical continuity is secured. The slot of the IDT terminals typically have V or U-shaped slots obtained by punching sheet metal, and the wires and the IDT terminals are connected with each other by press-fitting them together. When press-fitting the wires as described above, the wires are press-fit into the V or U-shaped slot so that the IDT terminals pierce the outer insulations of the wires to bring the inner conductors thereof and the terminals into contact with each other, thereby establishing electrical contact between the terminals and the wires.

In some other types of connectors, it is necessary to perform an insulation removal process using a special tool such as a stripper at the time of connection to the terminals. By using the above-described IDT connectors, there is an advantage in that the insulation removal may be dispensed with.

Incidentally, by merely press-fitting the wire into the slot of the IDT terminal, there is a fear that the wire in the IDT terminal drops off, due to vibrations generated during the use of an apparatus to which the IDT connector is applied, or due to an external force such as a tension generated on the wire.

In order to solve this problem, there are prior arts such as Japanese Utility Model laid-Open Publication No.Sho59-080971. In this prior art, the connector comprises wire pressing means for pressing on the wire, which has been pushed into the slot of the IDT terminal, within the slot in the pushing direction of the wire. According to such a connector, a wire that is about to be press-fitted into the slot of the IDT terminal is further forcibly pressed on by the wire pressing means, thereby preventing the wire from dropping off.

However, with the above connector, the wire is pressed on by the wire pressing means irrespective of the manner in which the wire is inserted in the IDT terminal, for example, even when its position is deviated from the center of the IDT slot. As a result, excessive strain may be exerted on the entire or part of the wire conductor, resulting in a stress concentration. Consequently, there is a fear that one of the following problems occur: a decrease in the sectional area of the conductor occurs which causes an increase in the resistance of the terminal-wire connection; the biased state causes a gap to be produced so that a part of the conductor does not come into contact with the IDT terminal; and due to the breaking of the wire, oxidation occurs due to moisture present in the air, thus reducing durability and causing a variation in the resistance value.

The present invention is therefore directed to a solution of the above-described problems.

SUMMARY OF THE INVENTION

It is a general object of the present invention to achieve IDT contact of the wire while retaining it properly in its normal and right position and also prevent excessive strain from being exerted on the conductor of the wire, thereby preventing a change in the contact resistance value or a degradation of the conductor.

In order to attain the above object, a connector of the present invention is constructed as described below. That is, the invention provides an IDT connector including: a base housing having fixed therein IDT terminals to which wires applied with outer insulation is press-fitted; a cover housing which is mounted to the base housing and has a guide hole into which the wire is inserted; and a wire holder which is provided to the cover housing and retains the wire that is to be inserted into the guide hole, in which the cover housing has a wire normal-position fixing means for fixing the wire in a normal position within the guide hole with respect to a connection direction of the wire (insertion direction of the wire), and wire connection is performed by displacing the wire, which is fixed in the normal position within the guide hole by the wire normal-position fixing means, into an IDT contact edge of the IDT terminal while retaining the wire in the wire holder.

According to the above arrangement, the insertion of the wire into the guide hole provided in the cover housing serves to ensure fixing of the wire in its normal position with respect to the wire connection direction. Further, while this state is being maintained by the wire holder, the cover housing provided with the wire holder moves into the base housing so that the wire is fixed to an appropriate position of the IDT terminal, thereby performing wire connection by the IDT contact in an extremely accurate manner. That is, because the wire can be brought into contact with the IDT terminal while remaining fixed in its normal position and in a state in which it is being pressed on the IDT terminal, a variation in the contact resistance is mitigated.

Further, since the wire is not forcibly pushed into the slot of the IDT terminal from its non-normal position, there is no excessive strain on the inner conductor of the electric wire. Therefore, since excessive concentration of stress does not occur in the conductor, it is possible to prevent degradation of the conductor as well as an increase in the contact resistance value resulting from contact failure of a part of the conductor.

Further, as a method for connecting a wire applied with an insulation to an IDT connector, the normal position of the wire in relation to the IDT terminal can be ensured by using a method including: a first step of inserting the wire into a guide hole inside a cover housing and temporarily locking the wire by a wire normal-position fixing means; a second step of retaining the wire by a wire holder provided to the cover housing; and a third step of pressing the wire holder and the cover housing toward a base housing by applying pressure thereon from the outside to bring the wire into IDT contact with an IDT terminal, thereby bringing a inner conductor of the wire and the IDT terminal into conduction with each other.

Further, by tapering the forward end portion of the wire insertion hole and then inserting the wire applied with the insulation into the wire insertion hole thus having a tapered bore, since a repulsion force generated upon abutment against the above-mentioned tapered bore increases as the wire applied with the insulation is inserted deeper into the wire insertion hole, temporary locking of the wire can be effected using the repulsion force.

It is desirable that, when being mounted on the cover housing, the above-mentioned wire holder is capable of being displaced to a position where it does not interfere with the wire when inserting the electric wire into the guide hole of the cover housing. With such an arrangement, the wire does not abut against the wire-retaining portion so that the wire-retaining portion does not drop off by being pressed on by the wire before the wire connection. Moreover, since the advance movement of the wire is not obstructed, it is possible to smoothly insert the wire into the wire insertion hole and maintain the wire in its normal position with respect to the connection direction thereof.

The above-mentioned wire-retaining portion may be guided by a displacement guiding portion so as to be displaced in a parallel direction.

It is also possible to provide a plurality of the IDT terminals in the base housing, with adjacent IDT terminals being staggered relative to each other in a zigzag pattern with respect to the wire connection direction. Such an arrangement prevents the IDT terminals from coming into contact with each other even if the width of each IDT terminal itself is set to a sufficiently large value from the viewpoint of mechanical strength, thereby achieving narrower pitches for the connector.

It is also possible to provide a protective guide plate for protecting a wire in a location where the electric wire-retaining portion that has been descended crosses the above-mentioned guide hole and to guide the electric wire with the protective guide plate during the insertion of the wires.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DETAILED DESCRIPTION OF THE PREFERRED EMBODIMENTS

A description will be given of an IDT connector 1 according to a first embodiment of the invention with reference to FIGS. 1–20. The IDT connector 1 is a so-called plug connector, which is composed of a base housing 3 and a cover housing 5 to be overlaid on the base housing 3.

Figure 10:
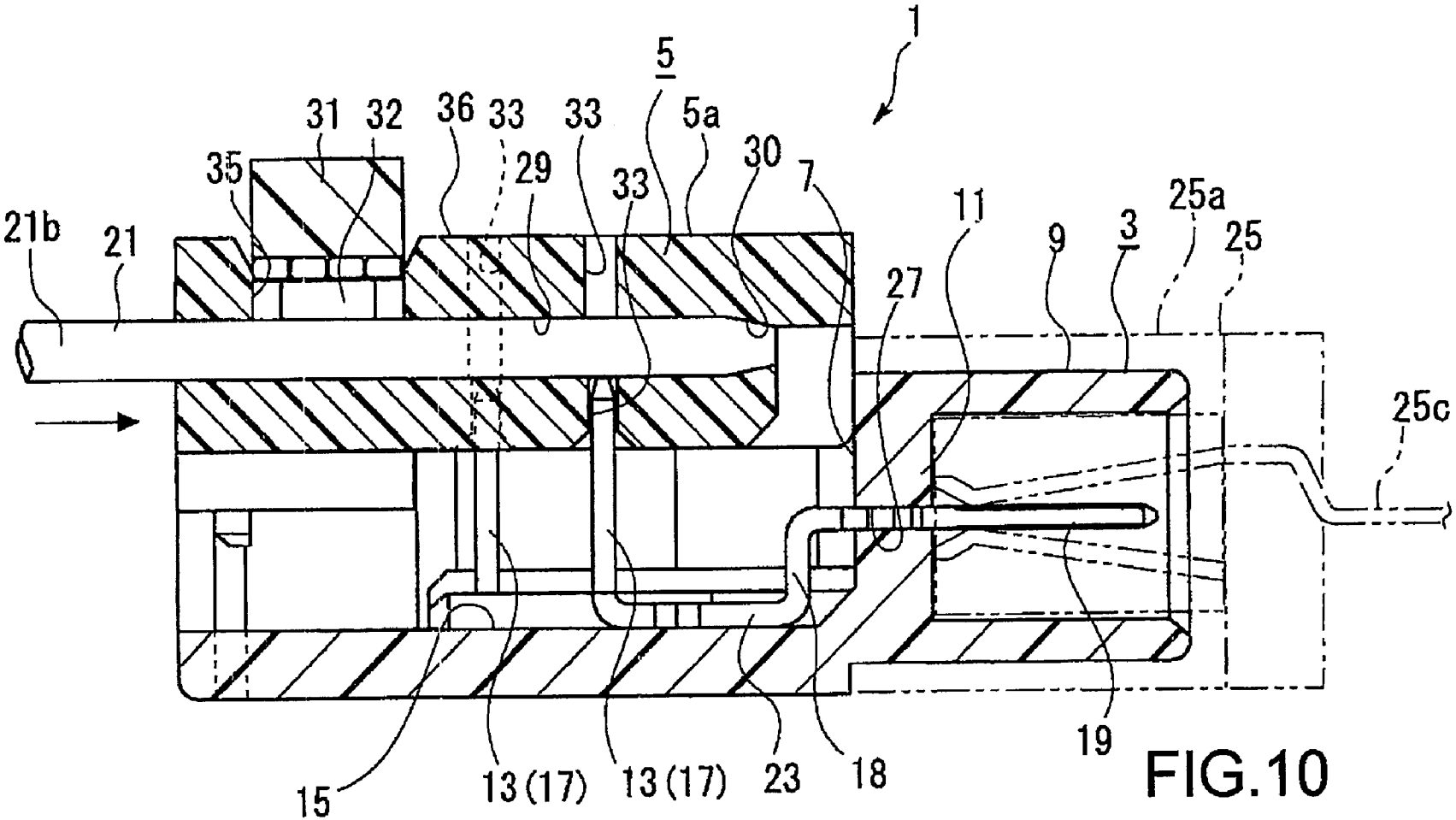
FIG. 10 is a sectional view taken along the line X—X of FIG. 6.
Figure 11:
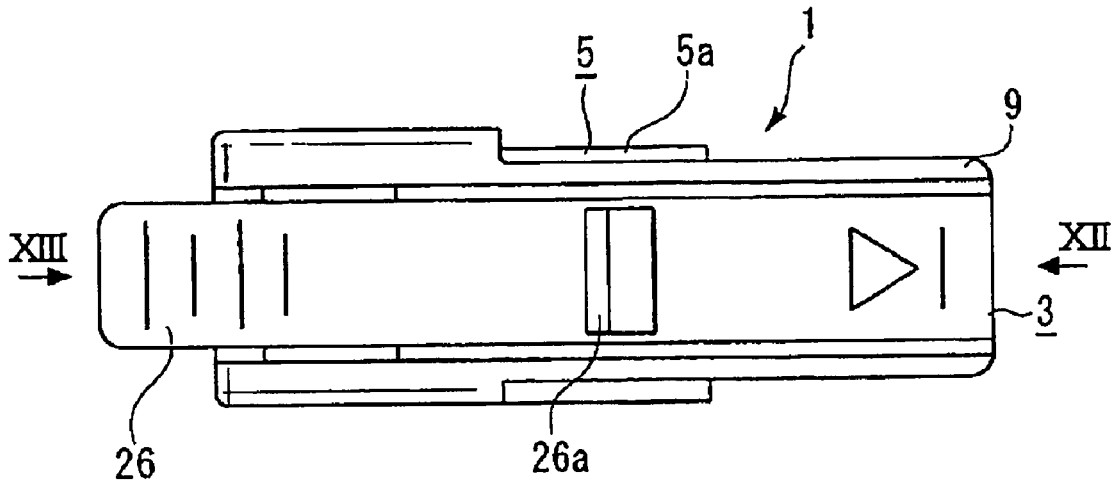
FIG. 11 is a side view showing a state in which the cover housing of the IDT connector according to the first embodiment of the present invention is incorporated into the base housing.
Figure 12:
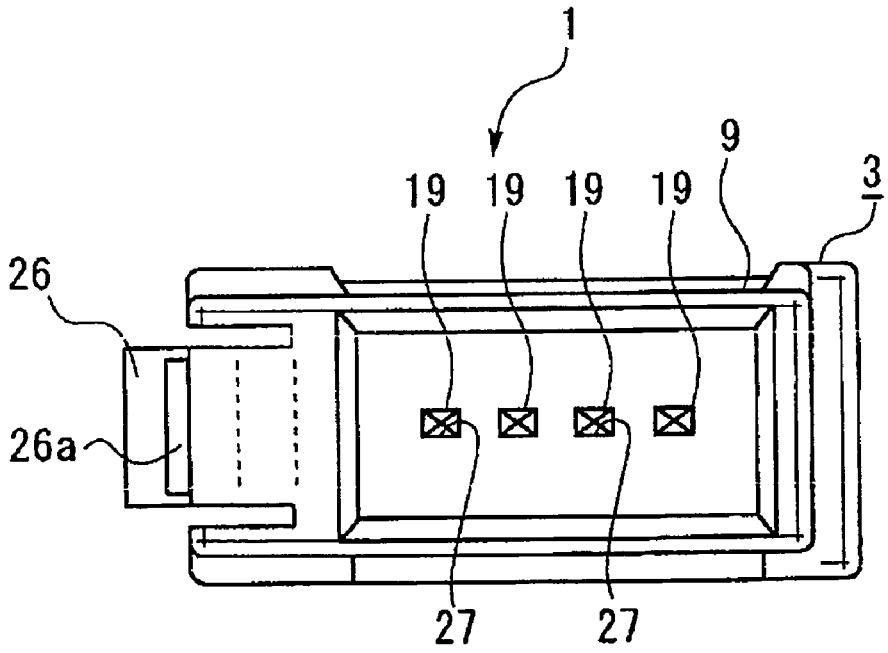
FIG. 12 is a view as seen from the direction of arrow XII of FIG. 11.
Figure 13:
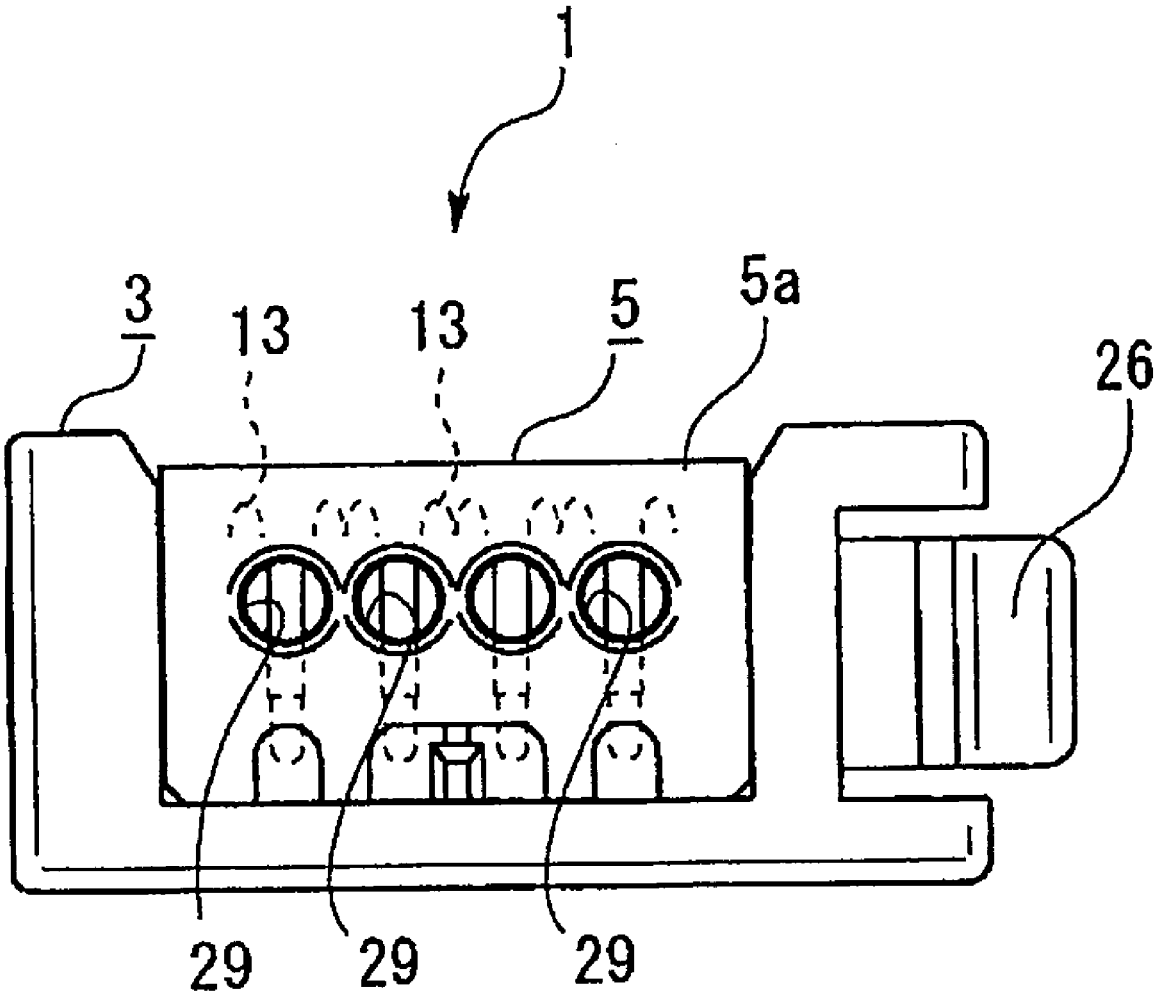
FIG. 13 is a view as seen from the direction of arrow XIII of FIG. 11.

The base housing 3 includes: a terminal chamber 7 surrounded by the cover housing 5 and in which a plurality of terminals 13 are fixed; a mating section 9 which is inserted into a receptacle connector 25 serving as a mating connector of the IDT connector 1; and a partition wall 11 located between the terminal chamber 7 and the mating section 9 (see FIG. 10).

Figure 14:
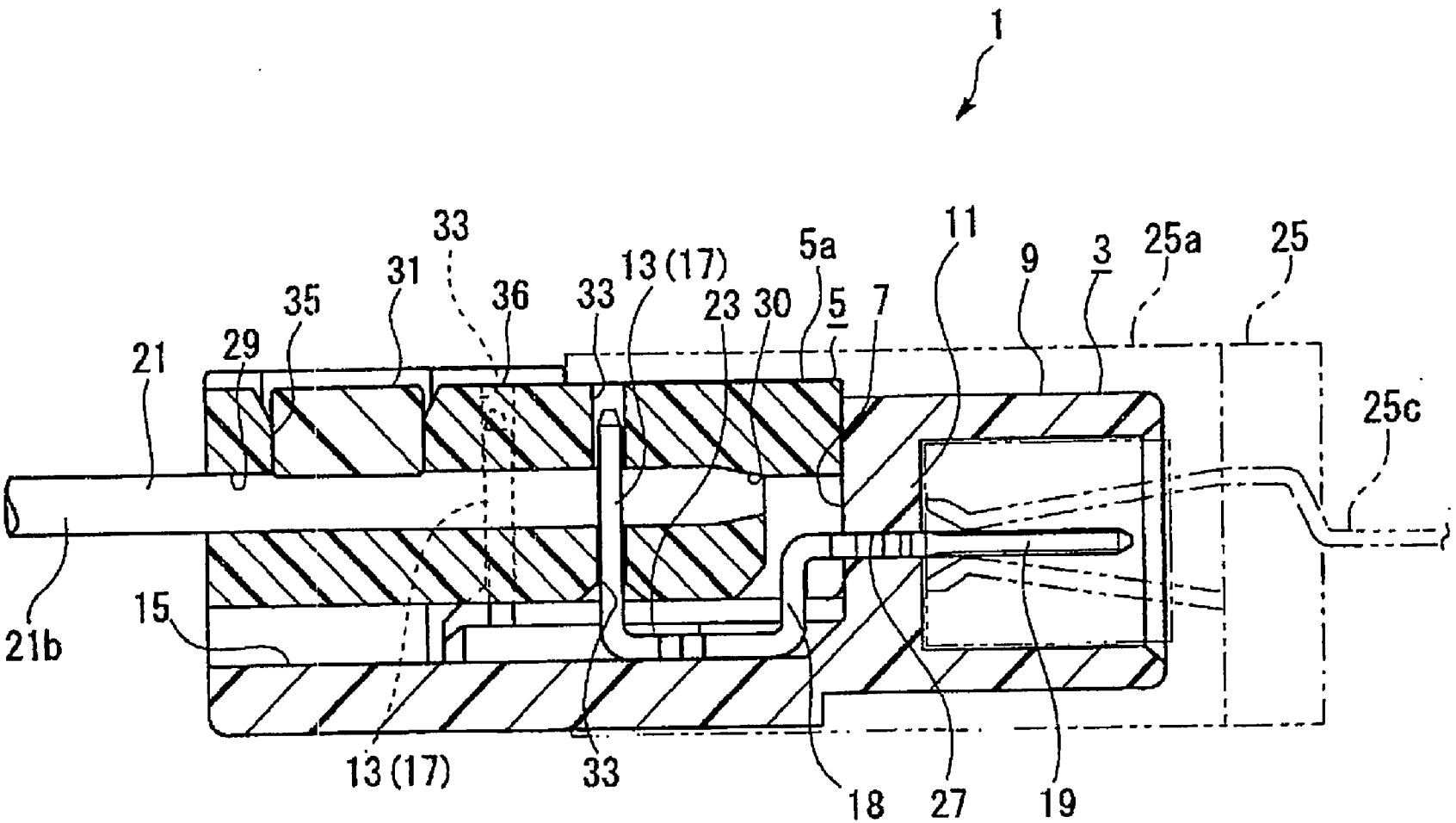
FIG. 14 is a sectional view showing a state in which, from the state shown in FIG. 10, the cover housing is incorporated into the base housing.

The terminal chamber 7 defines a bed in which plural (four in this embodiment) terminals 13 serving as IDT terminals are fixed onto a bottom surface 15 thereof (see FIGS. 10, 14 etc.).

Each terminal 13 is stamped and formed from sheet metal of phosphorus bronze. As can be seen in FIG. 10, in its side view, the terminal 13 has a shape such as obtained by horizontally orienting the question mark "?". Nickel plating is performed on the base material of the terminal 13. Further, in an IDT contact portion 17 that is cut through the outer insulation and electrically contact with a inner conductor

21*a* of an electric wire 21 (FIGS. 15 & 16) and a contact portion 19 (see FIG. 14) that is mated with the receptacle connector 25 shaped like a hollow box, the portions 17 and 19 each forming a part of the terminal 13, solder, such as tin-lead solder plating and gold plating are performed, respectively, on the nickel-plating layer. A top surface 25*a* of the receptacle connector 25 has a notch portion 25*a*1. The provision of the notch portion 25*a*1 prevents the receptacle connector 25 from abutting against a main body 5*a* of the cover housing 5 when it is mated with the IDT connector 1.

Note that a locking hole 25*b* is formed in a side surface of the receptacle connector 25. Further, the receptacle connector 25 has terminals 25*c* in an inner portion thereof, the terminals 25*c* each being in electrical contact with the contact portion 19 of each terminal 13. By soldering the terminals 25*c* onto a printed circuit printed circuit board 28, the receptacle connector 25 is fixed onto the printed circuit board 28.

Figure 15:
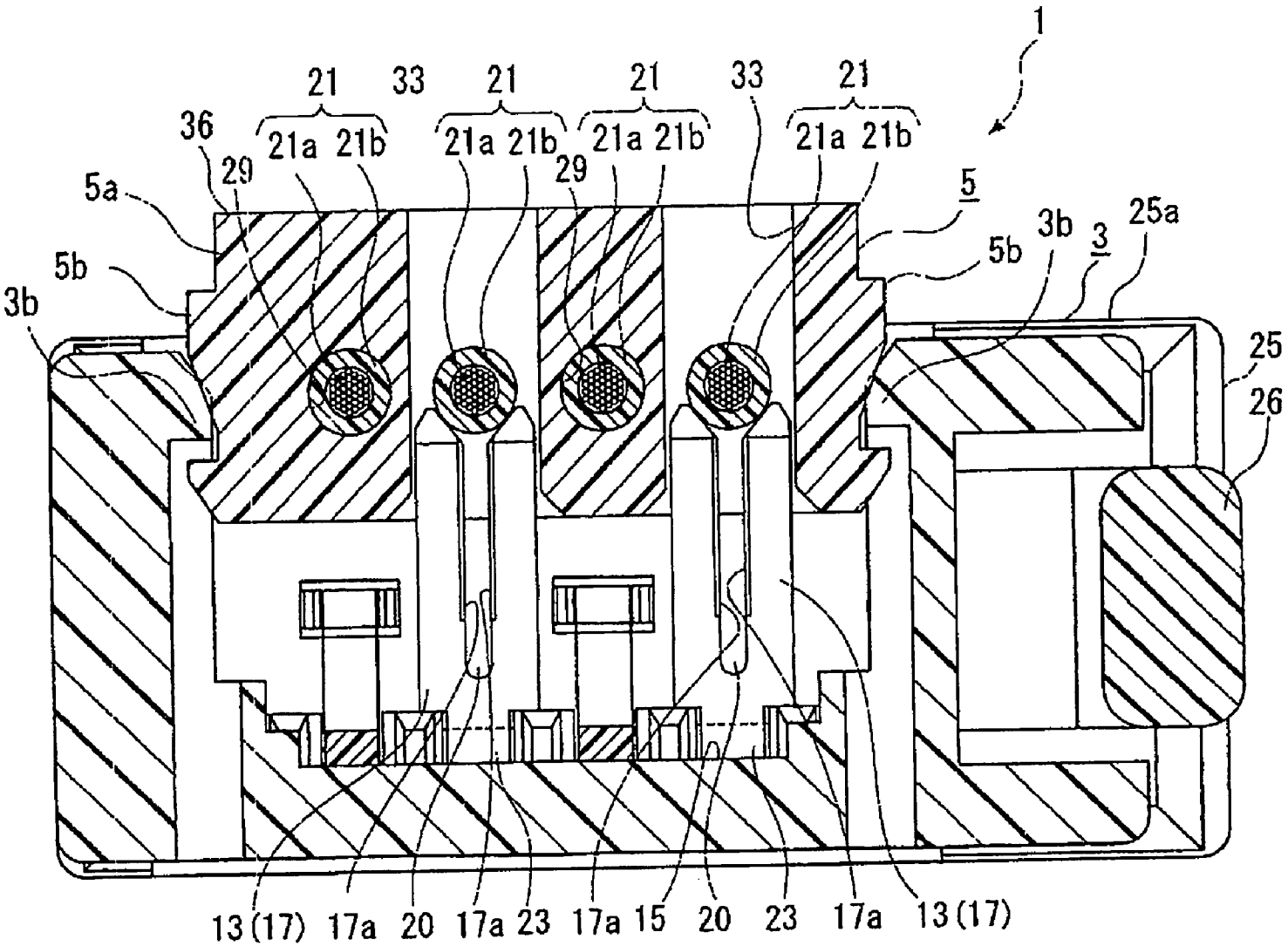
FIG. 15 is a sectional view taken along line XV—XV of FIG. 3.
Figure 16:
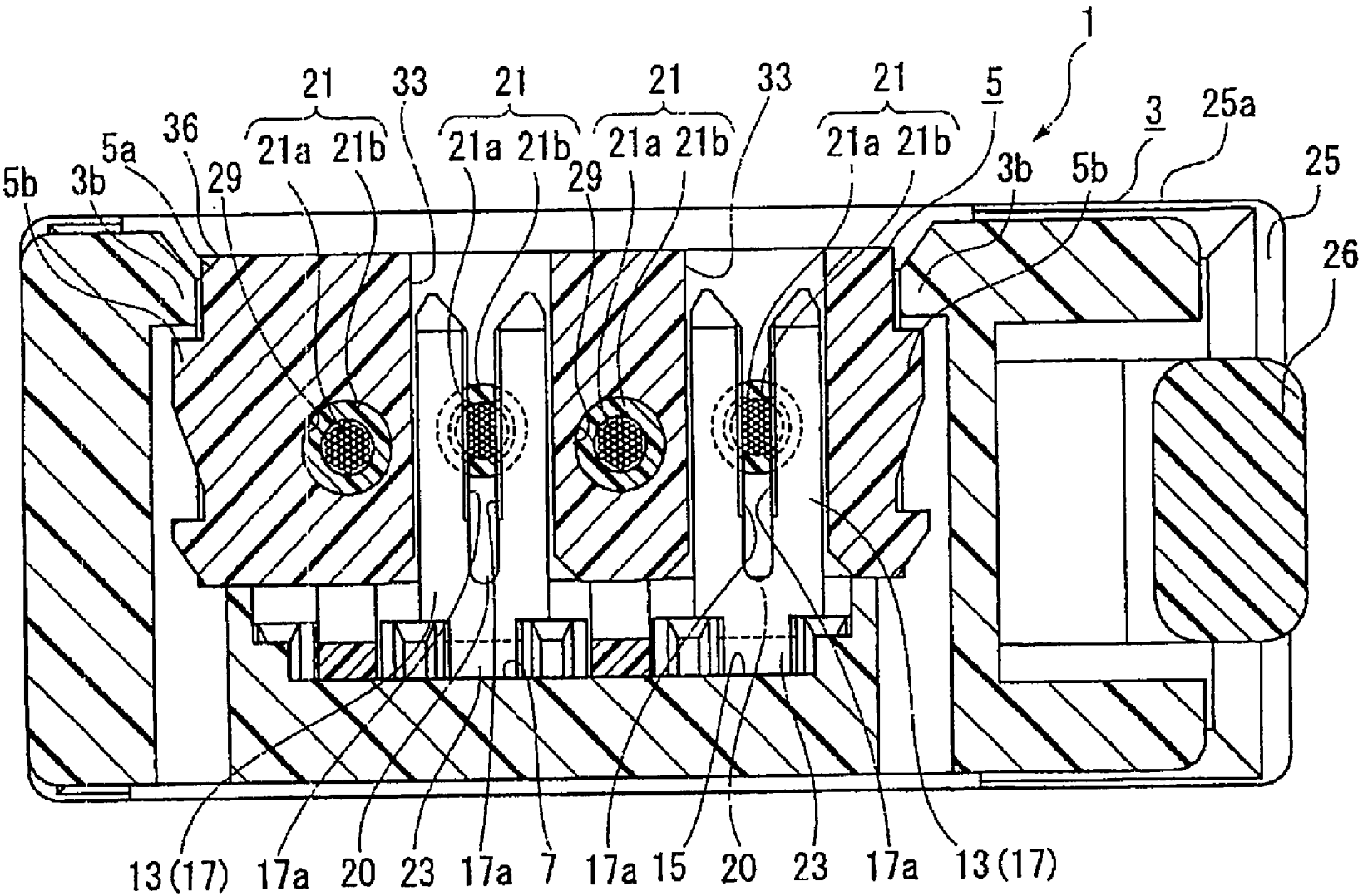
FIG. 16 is a sectional view showing a state in which, from the state shown in FIG. 15, the cover housing is incorporated into the base housing.

As can be seen from FIGS. 15 & 16, the IDT contact portion 17 with an IDT contact edge 17*a* has a U-shaped configuration. The wire 21 is press-fitted into a slot 20 of the IDT contact portion 17, which is formed due to the U-shaped configuration. The above-mentioned IDT contact edge 17*a* is formed in the slot 20. The terminal 13 has a base portion 23 which is a portion extending in the longitudinal direction of the terminal 13 from a proximal end portion of the IDT contact portion 17. The base portion 23 of the terminal 13 is placed on the base housing 3. Extending in an area further ahead of the base portion 23 via an upwardly offset part 18 is the contact portion 19.

By forming the above-mentioned offset part 18 in the terminal 13, the contact portion 19 is located substantially at the center of the mating section 19 with respect to the vertical direction (the vertical direction in FIGS. 10 & 14). This ensures degree of freedom in the designing of the recaptacle connector 25 serving as the mating connector of the IDT connector 1, which ultimately contributes to height reductions of the both connectors.

The mating section 9 serves as a fitting portion in which the receptacle connector 25 is fitted from the outside. A passage hole 27 for retaining the terminal 13 is formed in the partition wall 11 (FIG. 10). The passage hole 27 is formed to be somewhat smaller in width than the terminal 13 to allow the terminal 13 to be brought into a close fit therewith. Barb portions may be provided on sides of the terminal 13.

Figure 1:
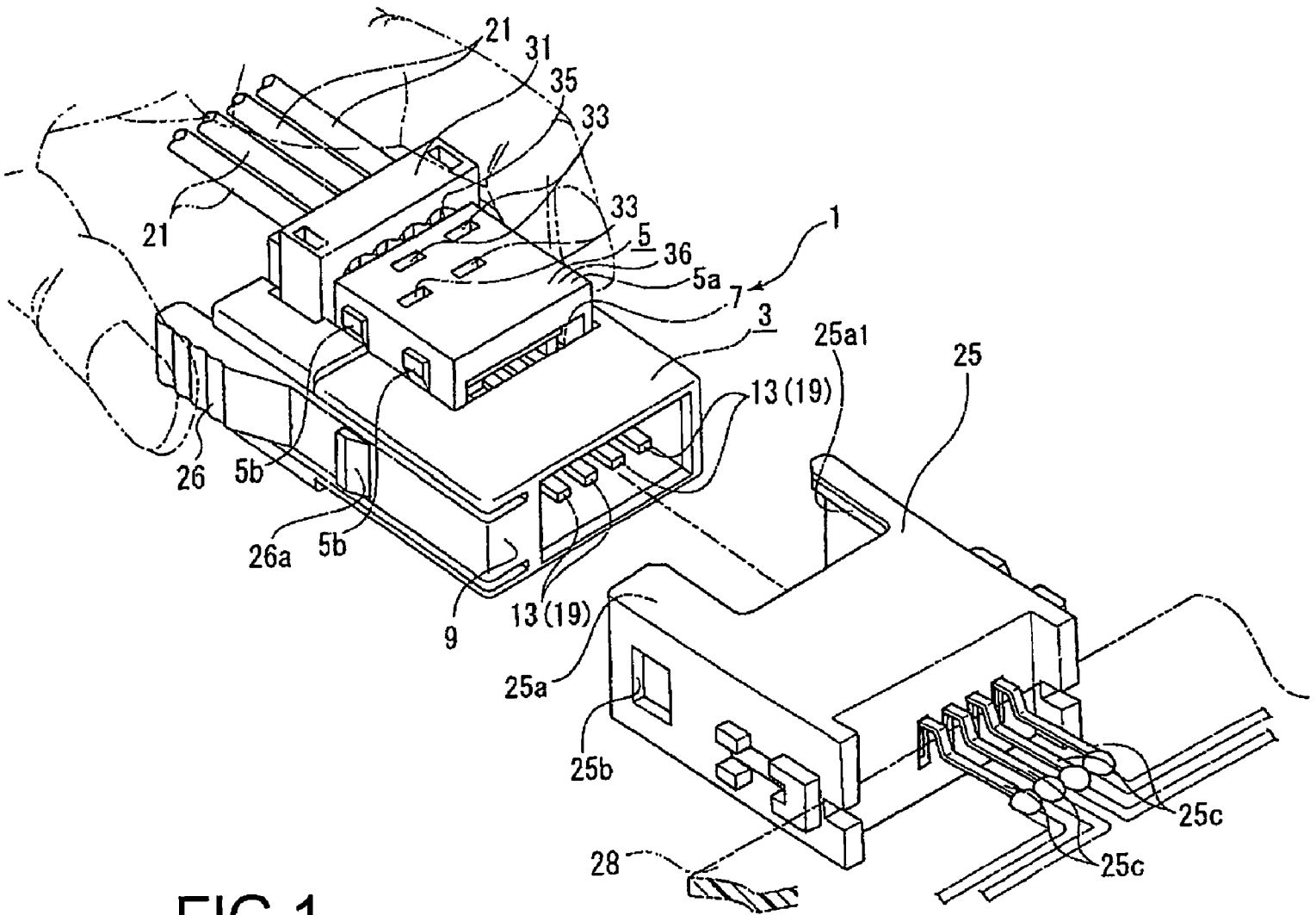
FIG. 1 is a perspective view showing a state immediately before an IDT connector according to a first embodiment of the present invention is fitted with a receptacle connector, with a cover housing thereof not having been incorporated into a base housing.
Figure 2:
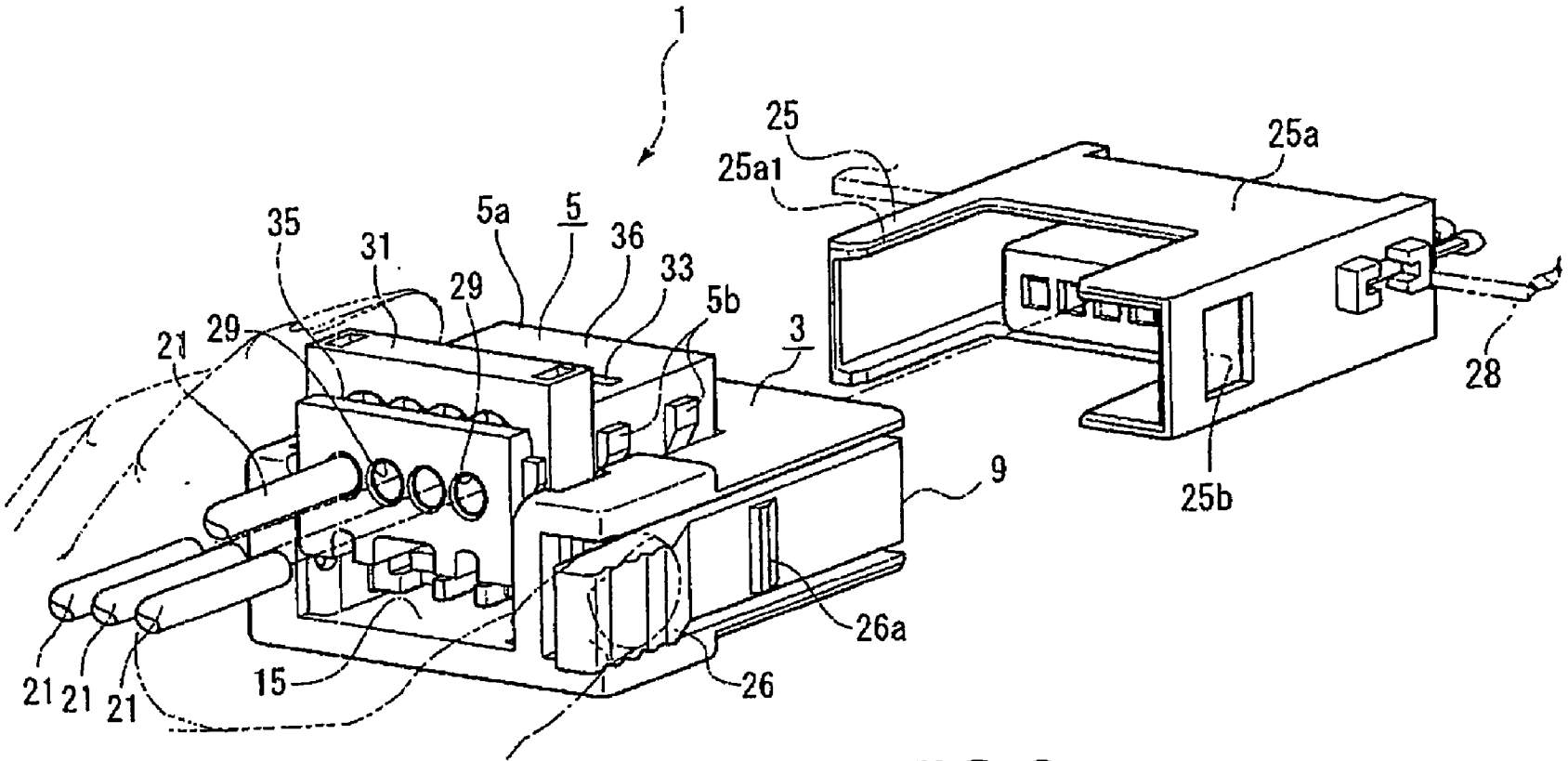
FIG. 2 is a perspective view of the connectors of FIG. 1 as seen from the rear.
Figure 3:
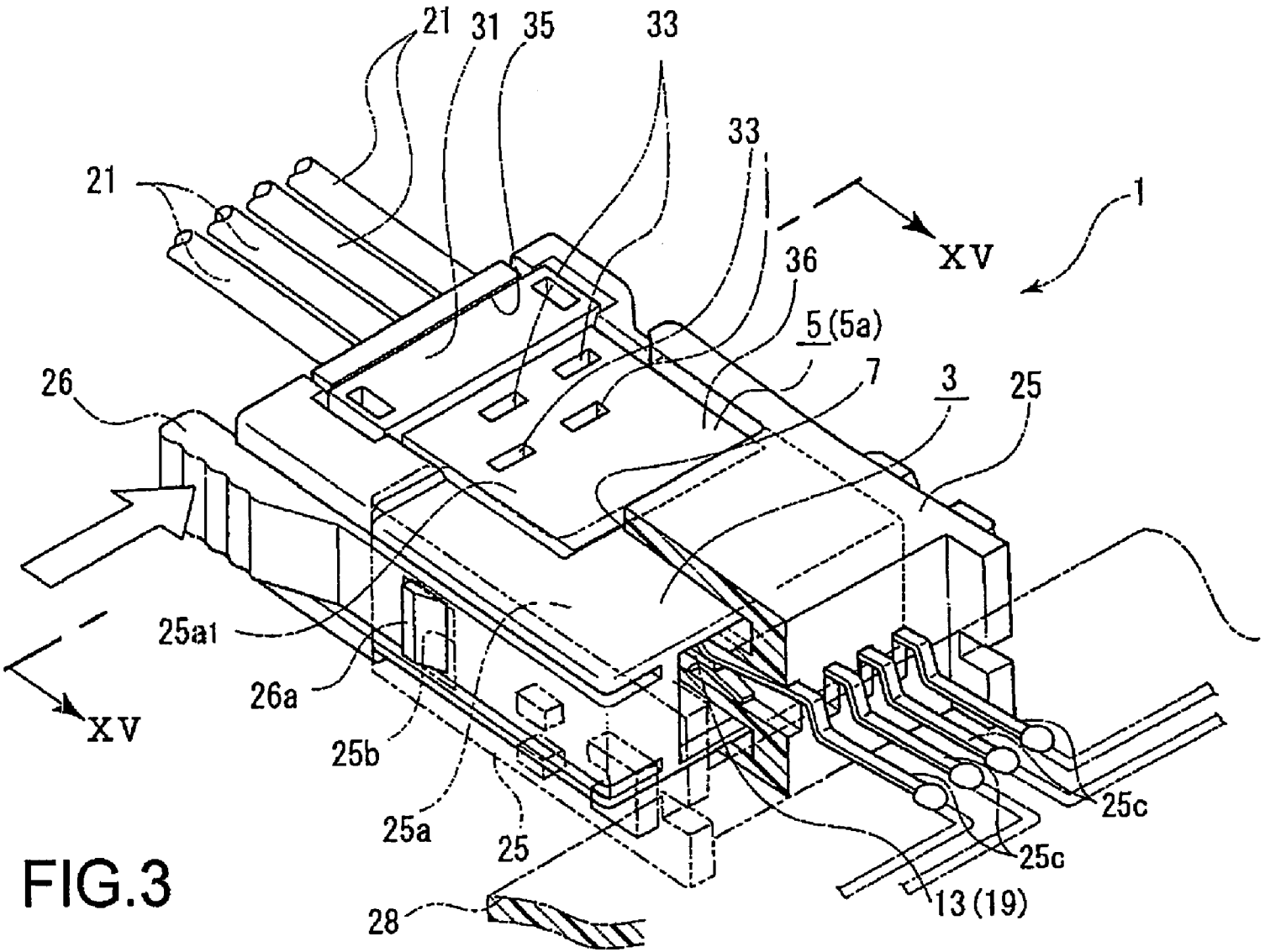
FIG. 3 is a perspective view showing a state in which the IDT connector of FIG. 1 is fitted with the receptacle connector, with the cover housing thereof having been incorporated into the base housing.
Figure 4:
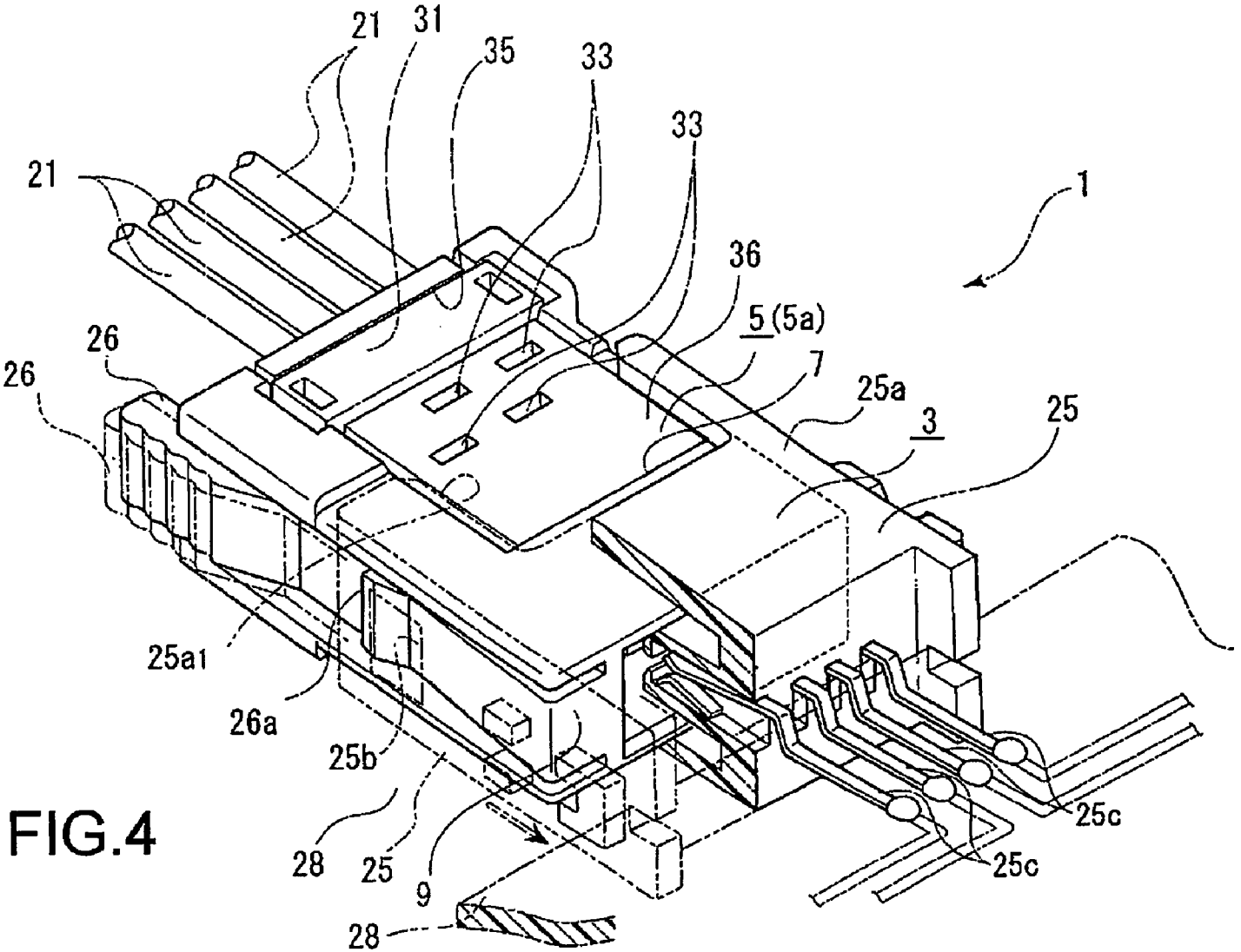
FIG. 4 is a perspective view showing a state immediately before dismounting the receptacle connector from that shown in FIG. 3.
Figure 5:
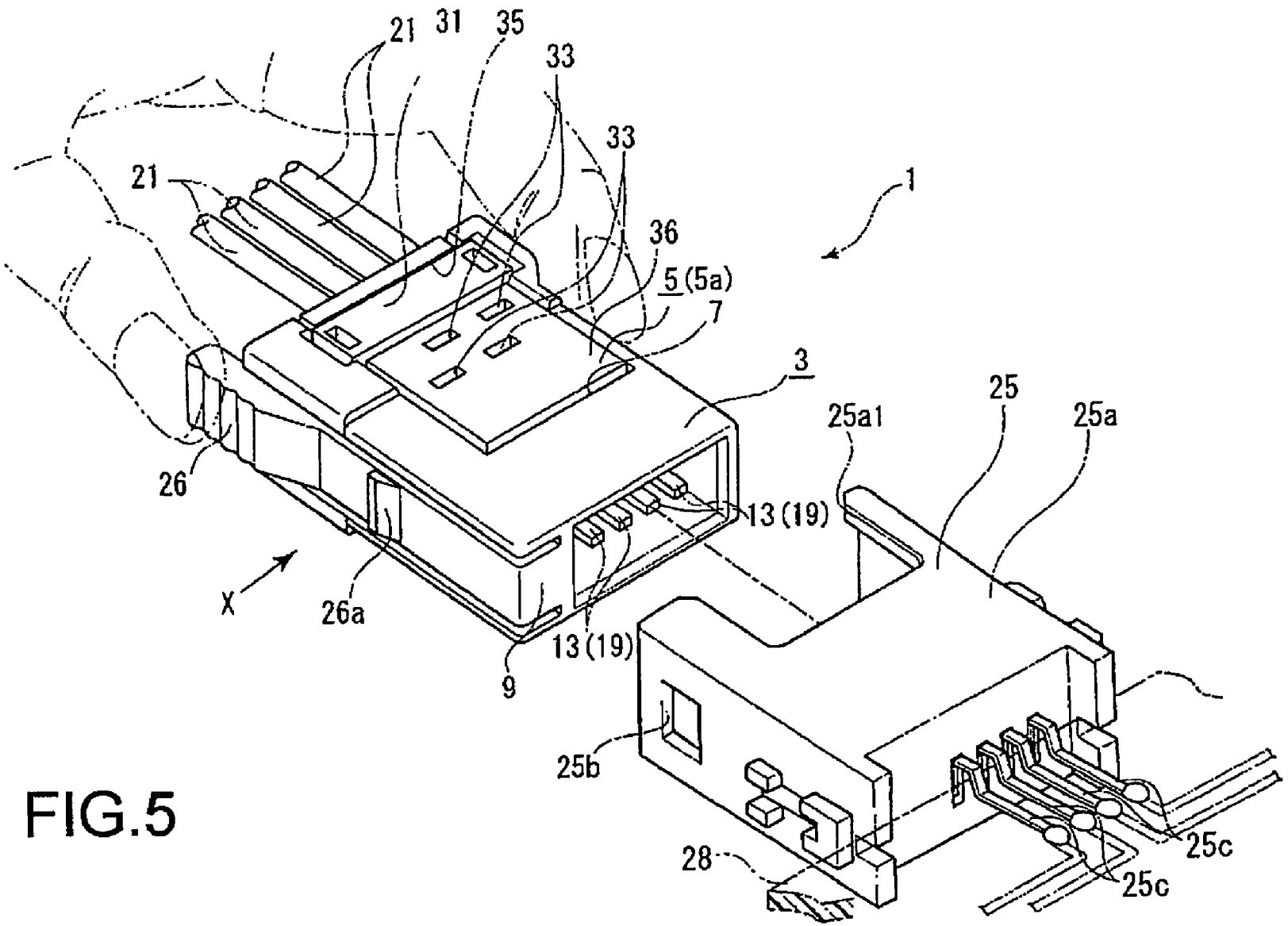
FIG. 5 is a perspective view showing a state in which the receptacle connector has been removed from the state shown in FIG. 4.
Figure 6:
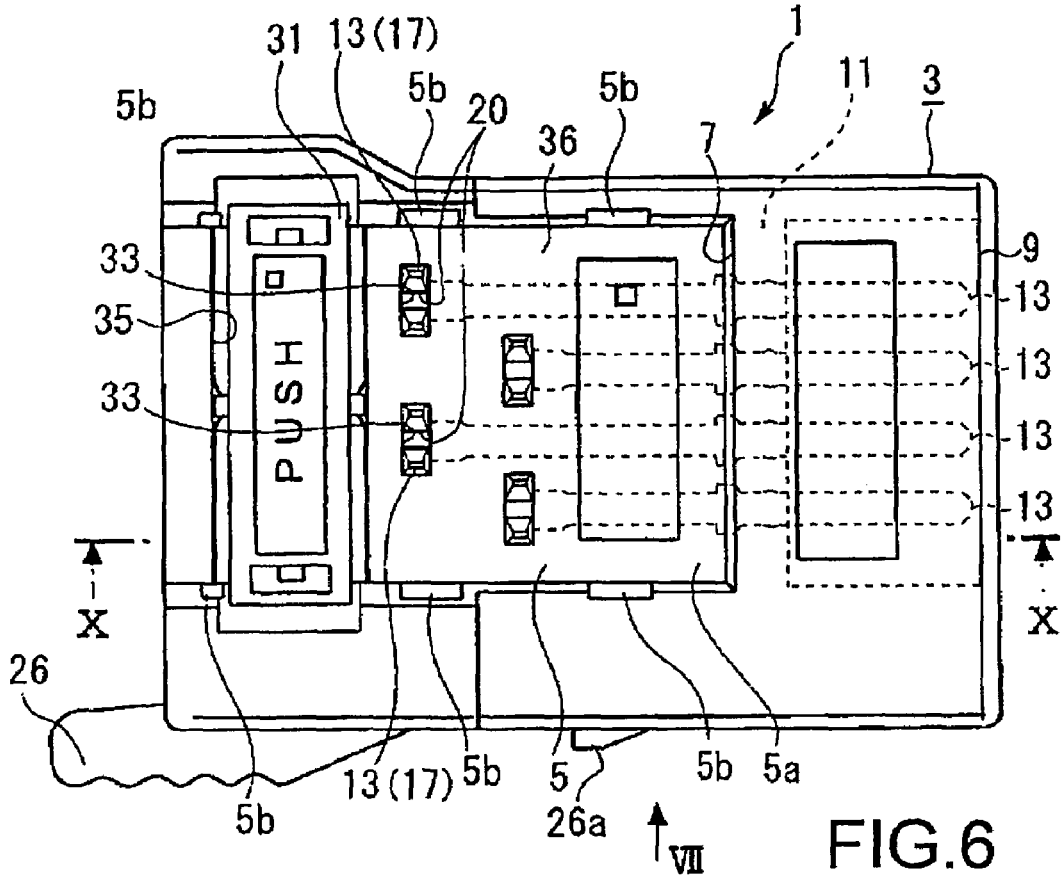
FIG. 6 is a top plan view of the connector of FIG. 1 in a state before the cover housing thereof is incorporated into the base housing.
Figure 7:
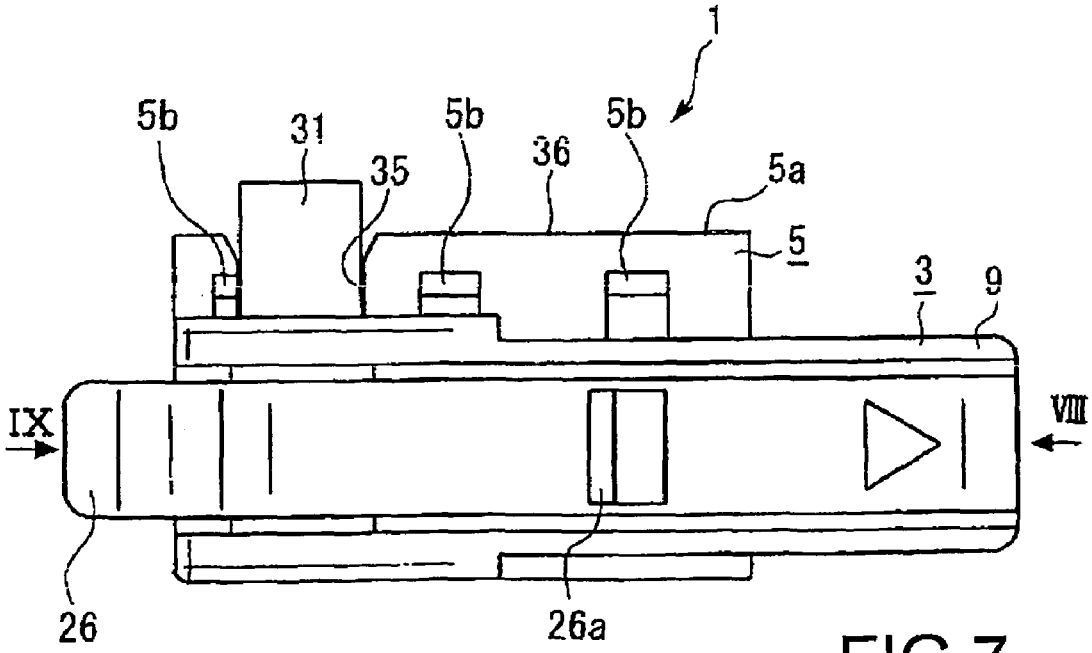
FIG. 7 is a side view of the connector of FIG. 6 taken along the direction of arrow VII of FIG. 6.
Figure 8:
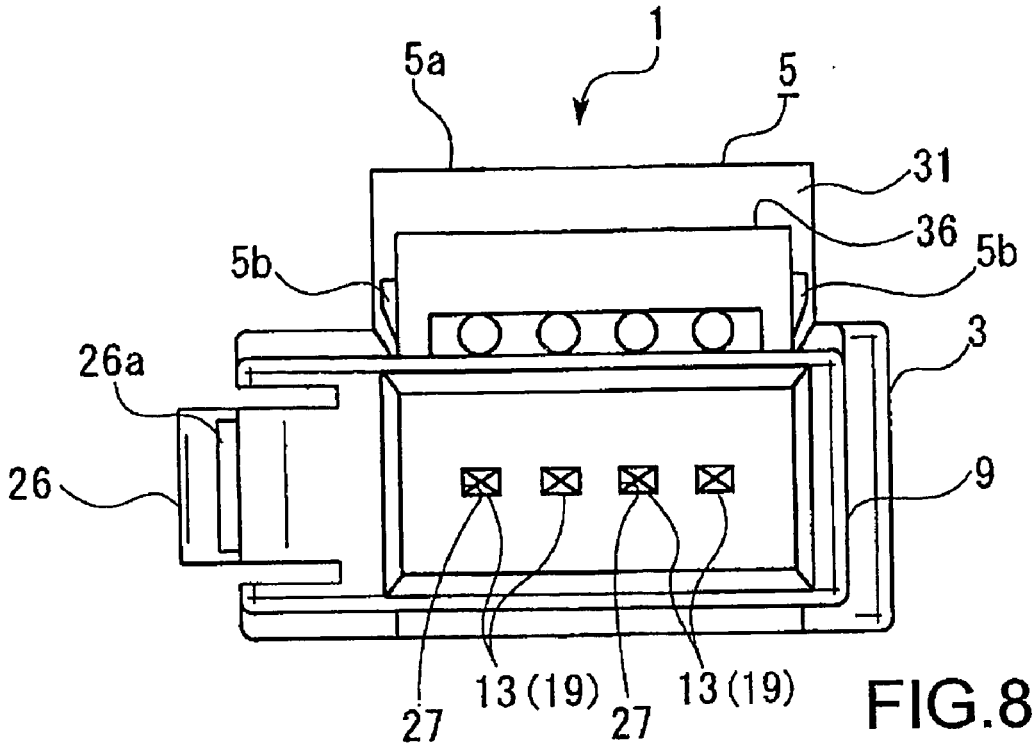
FIG. 8 is a front elevational view as seen from the direction of arrow VIII of FIG. 7.

As seen in FIGS. 1–3, a cantilever-like holding arm portion 26 is provided. The holding arm 26 is fixed at one end near the mating face 9 and free at the other end. Formed in the center of the holding arm 26 is a locking claw 26*a* which serves to maintain a fitting engagement between the receptacle connector 25 and the IDT connector 1 when no external force is being applied to the holding arm 26.

When the operator presses the holding arm 26 inwardly (as indicated by the while arrow of FIG. 3), the locking claw 26*a* moves inwardly, since the holding arm has elasticity. And the locking claw is released from the locking hole 25*b* of the receptacle connector 25 (see the change in the state of the holding arm 26 from that indicated by imaginary lines in FIG. 4 to that indicated by solid lines in the same figure). Unless the holding arm 26 is pressed as described above, the state of locking engagement is maintained (see FIG. 3).

Figure 9:
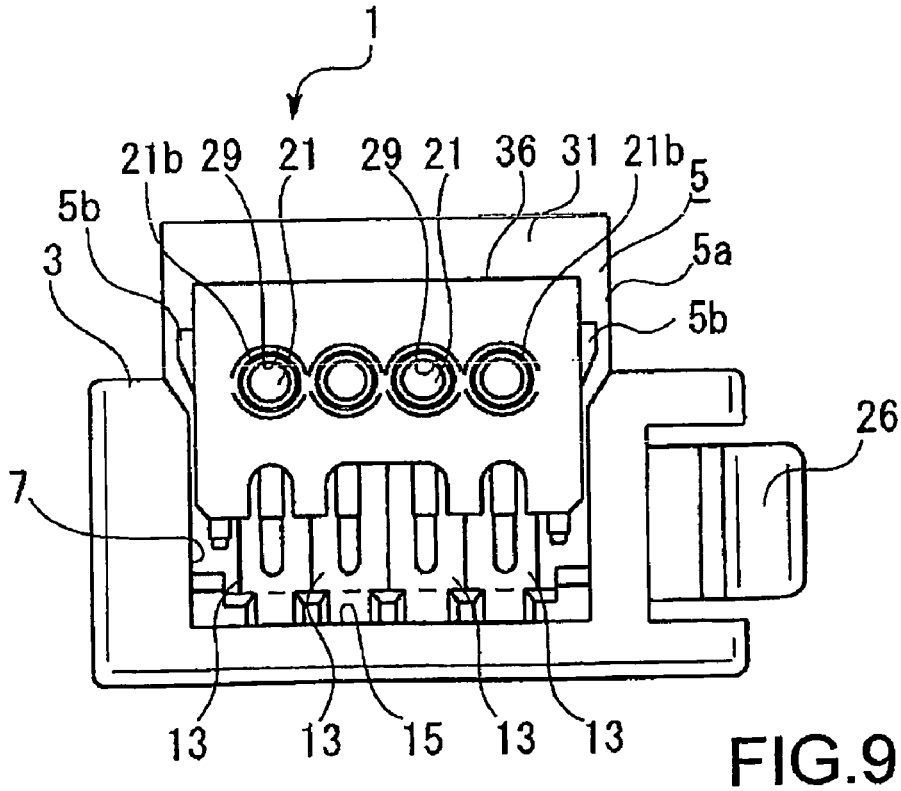
FIG. 9 is a rear elevational view as seen from the direction of arrow IX of FIG. 7.

As can be seen from FIGS. 2, 9, 10, etc., the cover housing 5 has in the main body portion 5*a* thereof a plurality (four illustrated) of wire insertion or guide holes 29 into which the electric wires 21 of the above-mentioned external circuit are inserted. The wire insertion hole 29 penetrates longitudinally through the cover housing 5. Further, the four wire insertion holes 29 are arranged in parallel in the widthwise direction (the direction orthogonal to the longitudinal direction of the cover housing 5) at equal intervals. In each wire insertion hole 29, the forward end portion thereof as seen in the insertion direction of the wire 21 is tapered to form a tapered bore 30. In the inner surface of the guide hole 29, the portion of the tapered surface is gradually reduced in diameter relative to the diameter of the wire 21 applied with an insulation 21*b*.

Further, the cover housing 5 includes: IDT contact slits 33 each for press-fitting the wire 21 to each IDT contact portion 17 and maintaining the electrical connection state between the both; and an electric wire holder 31 for maintaining a normal state of the wire 21 during the press-fitting, which also functions as a strain relief after the electric connection is established, that is, as a part for protecting a location where mechanical strength is insufficient beause the insulation 21*b* is torn off by the IDT contact edge 17*a* in establishing the IDT contact connection, so that an external force such as a tensile force is not exerted thereon through the wire 21.

The wire holder 31 extends orthogonal to the longitudinal direction of each wire insertion hole 29 formed in the main body 5*a*. Thus, the cover housing 5 is provided with an opening 35 for allowing the wire holder 31 to be slid in the longitudinal direction of the wire insertion hole 29 while being oriented orthogonal thereto (FIGS. 1–7, 10 & 14). The opening 35 is a through hole penetrating from a top surface 36 of the cover housing 5 to each wire insertion hole 29. The wire holder 31 is guided along the opening 35. Then, by pressing the top of the wire holder 31 in the state where the wire is being inserted into the wire insertion hole 29, the wire holder 31 moves to a location where it is in close contact with the top surface of the insulation of the wire 21 and retains the wire 21. In this state, the top surface of the wire holder 31 is substantially coplanar with the top surface 36.

Figure 18:
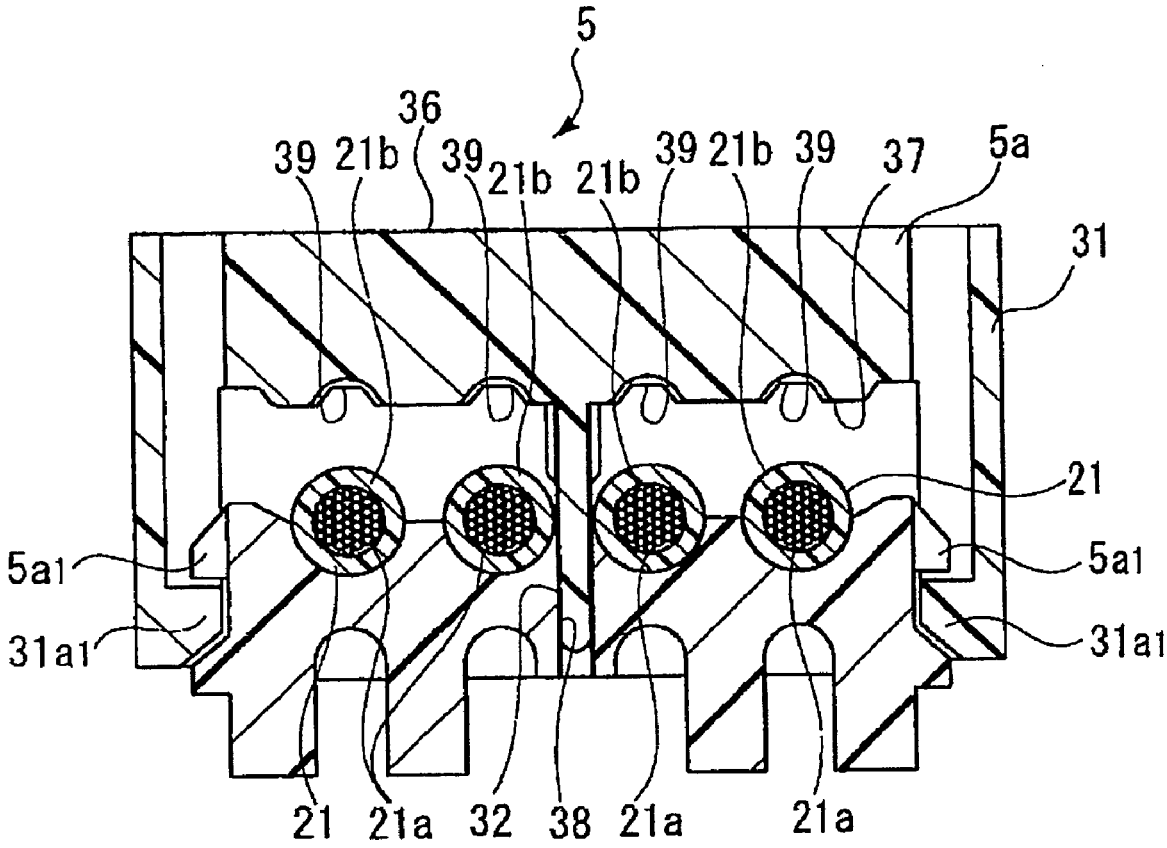
FIG. 18 is a sectional view taken along the line XVIII—XVIII of FIG. 17, in which the wire holder is indicated by a solid line.
Figure 19:
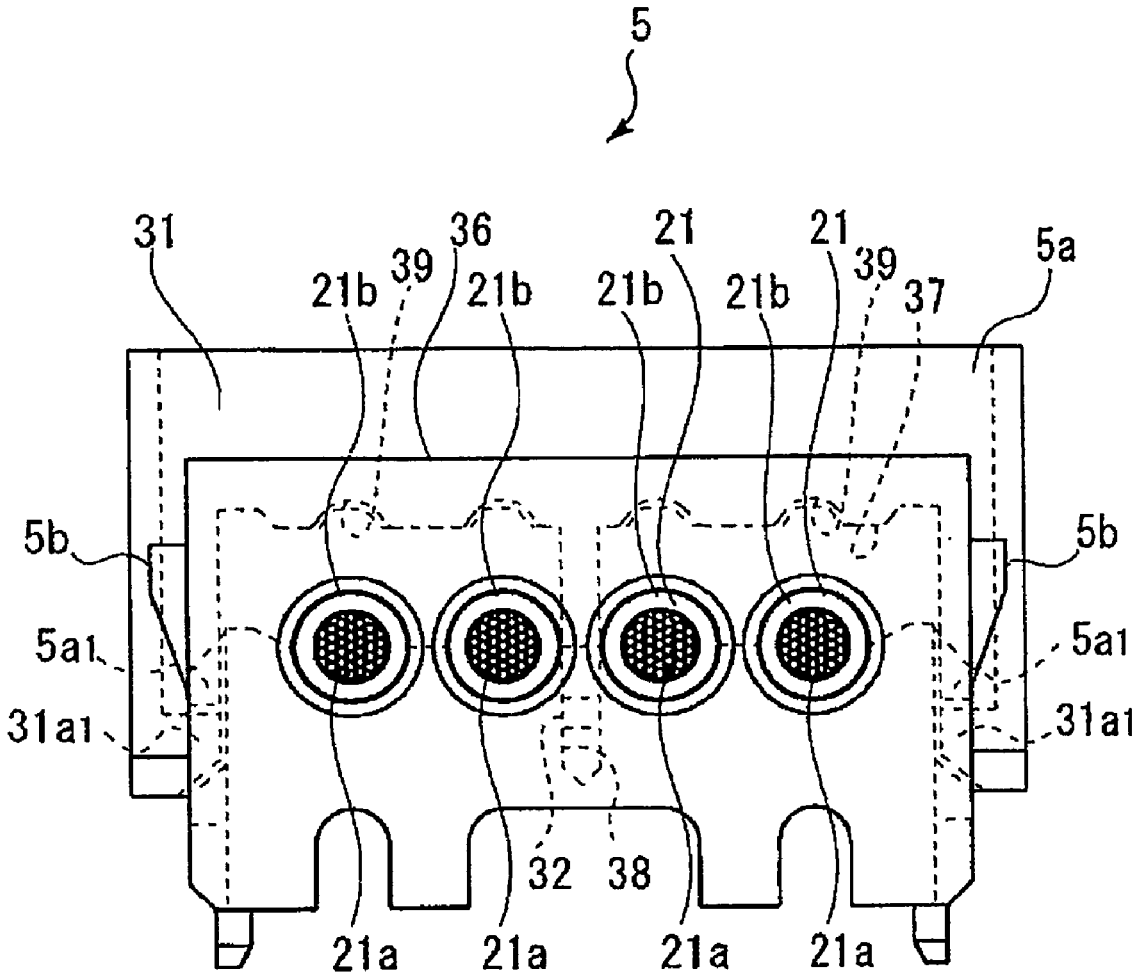
FIG. 19 is a view as seen from the direction of arrow XIX of FIG. 17, in which the wire holder is indicated by a solid line.

The wire holder 31 has on the underside a guide projection 32 for vertically guiding the same (FIGS. 10, 18 & 19). The guide projection 32 is a rectangular plate portion extended vertically toward the base housing 3 from the center of a lower surface 37 of the wire holder 31 (FIGS. 18, 19), which opposes the wires 21.

Figure 17:
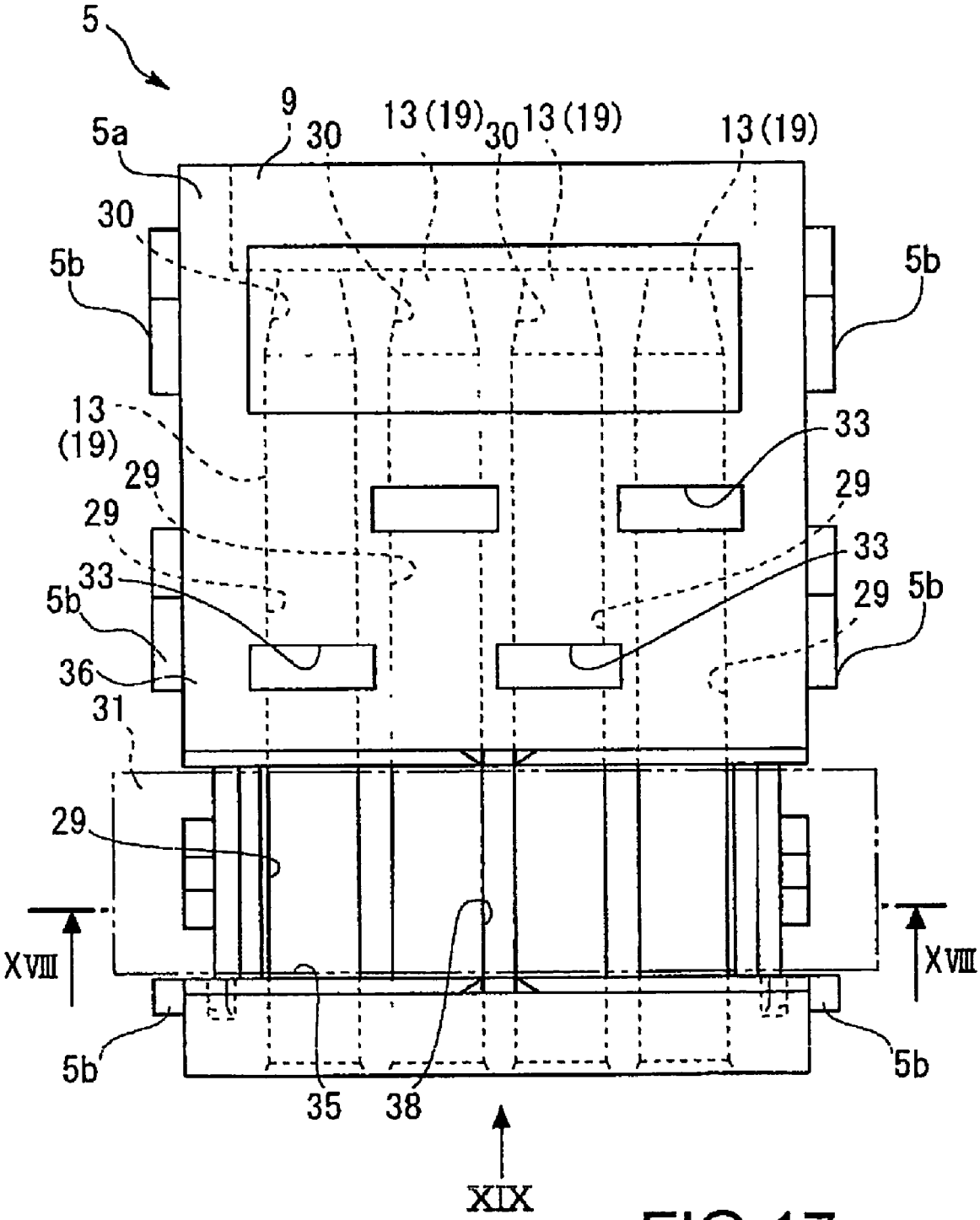
FIG. 17 is a plan view of the cover housing in which a wire holder is indicated by an imaginary line.

The guide projection 32 extends in the axial direction of the wire insertion hole 29. Further, the above-mentioned cover housing 5 has a guide slit (guide hole) 38 into which the guide projection 32 is inserted (FIGS. 17, 19). When the guide projection 32 is inserted into the guide slit 38 to move within the guide slit 38, the holder 31 can be displaced between its upper-ready position (shown in FIG. 10 in which the holder 31 protrudes from the cover housing 5) and its lower-fixed position (shown in FIG. 14 in which the holder 31 is received within the housing 5) in parallel, that is, while maintaining the same orientation.

It should be noted that in the upper-ready position, the wire holder 31 does not interfere with the electric wire 21, so that this position can be referred to as an electric wire non-fixing location. Also, in the lower-fixed position, the holder 31 interferes with the electric wire 21, so that this position can be referred to as an electric wire fixing location. Because the wire holder 31 is thus displaced in parallel between the upper-ready position and the lower-fixed position by inserting the guide projection 32 into the guide slit 38, the guide projection 32 and the guide slit 38 are referred to as the "displacement guiding portions" in this description. Further, for the purpose of maintaining the completely descended state of the holder 31, a locking claw 31$a_1$ and a locking claw $5a_1$, are formed on a side portion of the holder 31 and on the main body 5*a* of the cover housing 5, respectively. (FIG. 19.)

Further, on the lower surface 37 mentioned above (FIGS. 18, 19), plural (four in this embodiment) recess slots 39 of a minor arc cross-sectional shape are formed, each in association with the cylindrical surface of the insulation 21*a* of each wire 21.

The IDT contact slot 33 (FIGS. 1–6, 10 and 14–17) is formed so as to extend orthogonal to the wire insertion hole 29 and be shifted in position relative to the wire holder 31 with respect to the longitudinal direction of the wire insertion hole 29. This arrangement is effective in securing a sufficient sectional area for the IDT contact portion 17 that serves as the IDT contact edge, without enlarging the pitch between each electric wire. In other words, this arrangement serves to prevent a situation where the IDT contact portion 17 is excessively deformed and broken due to a surface tension exerted when the electric wire 21 applied with the insulation 21*b* is pressed onto the IDT contact edge.

Upon mounting the cover housing 5 to the base housing 3, the IDT contact portion 17 which is attached to the base housing 3 is partially inserted into the cover housing 5 to reach the wire insertion hole 29 and, at the same time, it cuts through the outer insulation 21*b* of the electric wire 21, whereby the inner conductor 21*a* and the terminal 13 are brought into direct contact with each other.

Figure 20:
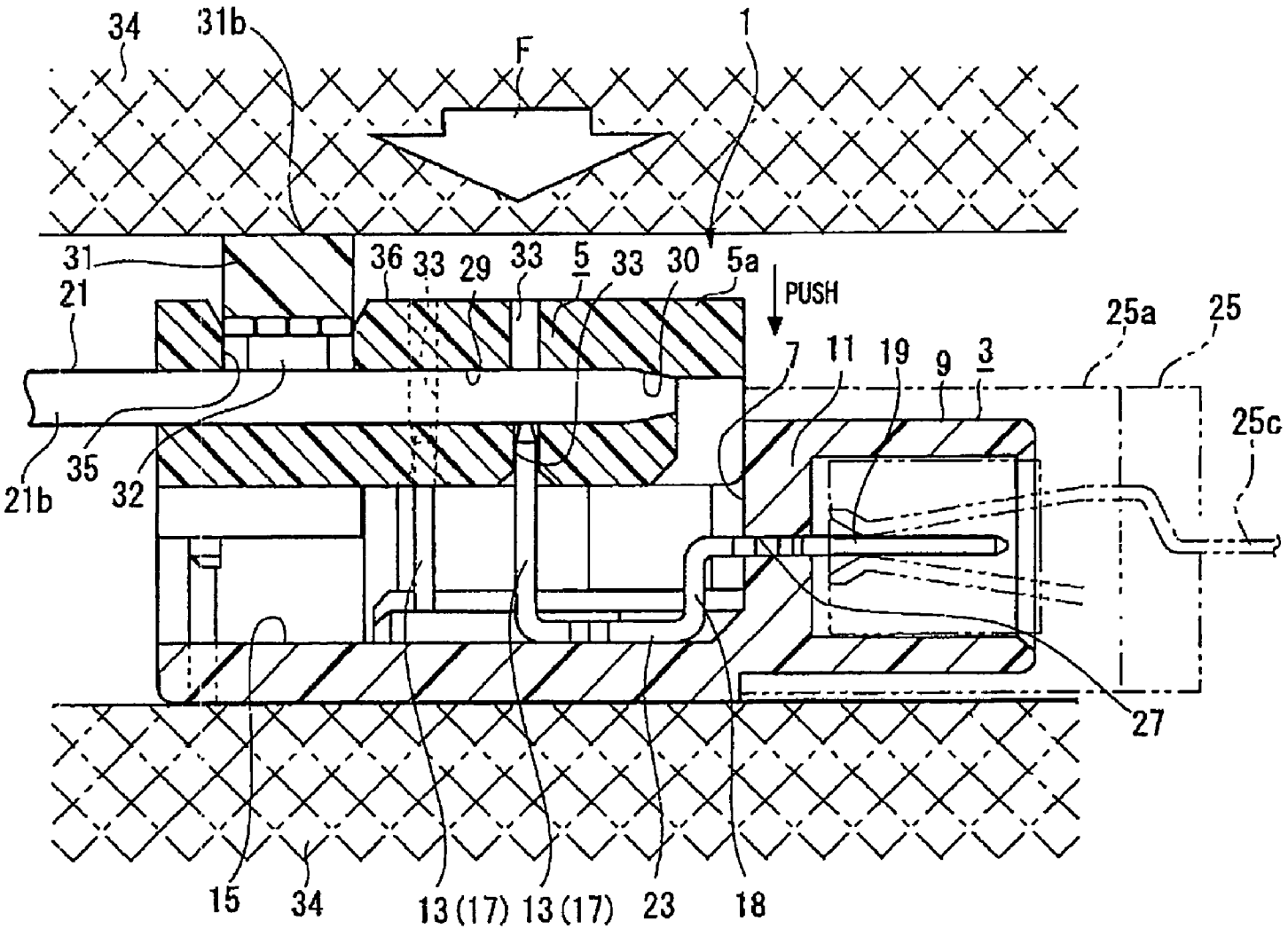
FIG. 20 is a view showing a state in which the connector according to the present invention is pinched by a tool such as pliers or a jig.

Mounting of the IDT connector 1 constructed as described above is effected with the cover housing 5 being received within the base housing 3 as shown in FIG. 14, by way of the state shown in FIG. 10 and the state shown in FIG. 20. As can be seen from FIGS. 15 and 16, plural engaging protrusions 5*b* for maintaining the state in which the cover housing 5 is received within the base housing 3 are formed on side surfaces of the cover housing 5. Further, engaging protrusions 3*b* to be engaged with the above-mentioned engaging protrusions 5*b* are formed on the base housing 3.

The engagement between the engaging protrusion 5*b* and the engaging protrusion 3*b* prevents the cover housing 5 from becoming dislodged from the base housing 3. That is, in the state shown in FIG. 10, the wire 21 applied with the insulation 21*b* is first inserted into the wire insertion hole 29 of the cover housing 5. As the wire 21 is pushed deeper into the wire insertion hole 29, it eventually reaches the tapered bore 30. At that point, since the diameter of the wire 21 applied with the insulation 21*b* is larger than the diameter of the tapered bore 30, the leading end of the wire 21 is subjected to a pressing force, preventing further advance movement thereof. That is, by performing tapering on the forward end of the wire insertion hole 29, temporary locking of the wire 21 can be effected utilizing the repulsion force of the wire 21 abutting against the tapered bore 30. At this time, the position in which the wire 21 is temporarily locked and fixed within the wire insertion hole 29 is hereafter referred to as a normal position in the wire connection direction (wire insertion direction). Accordingly, the tapered bore 30 is hereafter referred to as electric wire normal-position fixing means 30. Further, the forward end portion of the IDT contact portion 17 is inserted into the IDT contact slit 33 of the cover housing 5.

Next, as shown in FIG. 20, the IDT connector 1 is pinched with a tool 34 such as a vice or pliers. At first, an external force F is applied onto the top surface of the wire holder 31, so that the holder 31 then moves within the opening 35 from the electric wire non-fixing location shown in FIG. 10 to a position for pressing on the wire 21.

When the top surface 31*b* of the wire holder 31 becomes coplanar with the top surface 36 of the cover housing 5, the external force F applied by the tool 34 is exerted on both the wire holder 31 and the top surface 36 of the cover housing 5, thus pushing the cover housing 5 toward the terminal chamber 7 of the base housing 3.

As a result, the IDT contact connections to the wires 21 each being applied with the outer insulation 21*b* are effected at once, so that the inner conductor 21*a* (see FIGS. 15 and 16) of each wire 21 comes into direct contact with the terminal 13.

As has been described above, in the IDT connector 1 according to this embodiment, the wire 21 applied with the insulation 21*b* is inserted into the wire insertion hole 29 of the cover housing 5, thereby ensuring the normal position of the wire 2 with respect to the connection direction thereof relative to the terminal 13 when the cover housing 5 is incorporated into the base housing 3. Further, because the wires 21 are locked in place by the wire holder 31 those functions as a strain relief, the normal location of the wires 21 is maintained.

As described above, the wire 21 is press-fit into the slot 20 of the terminal 13 in an extremely accurate and orderly fashion, thereby eliminating a situation where degradation occurs in the conductor 21*a* of the wire 20 from excessive strain, the sectional area of the conductor 21*a* is reduced, or the contact resistance varies among the respective press-fitting positions.

In other words, as a method for connecting the wire 21 applied with the insulation 21*b* to the IDT connector 1, the wire 21 is fixed in place by using a method including: a first step of inserting the wire 21 into the wire insertion hole 29 inside the cover housing 5 and temporarily locking the electric wire by a taper portion 30 which is electric wire normal-position fixing means; a second step of retaining the wire 21 in the wire holder 31 provided to the cover housing 5; and a third step of pressing the holder 31 and the cover housing 5 toward the base housing 3 by applying pressure thereon from the outside to bring the wire 21 into IDT contact with the IDT terminal 13, thereby bringing the conductor 21*a* of the wire 21 and the IDT terminal 13 into conduction with each other. Therefore, it is possible to ensure the normal position of the wire 21 in relation to terminal 13.

Next, a description will be given of a second embodiment of the present invention using FIGS. 21–24. A connector according to the second embodiment is different from the connector according to the first embodiment only with respect to the cover housing. Therefore, a description will be given of only the cover housing.

The differences of a cover housing 50 according to the second embodiment from the cover housing 5 according to the first embodiment are three-folds: 1) there are provided plural guide projections for guiding the wire holder and plural guide slits for engagement with the guide projections; 2) the guide projection itself is imparted with the function of the wire holder; and 3) a protective guide plate is provided at the crossing part between the opening and the wire insertion hole, and the guide slit is formed in the protective guide plate. Therefore, a detailed description thereof is omitted by giving the same reference numerals to the same or similar parts.

Figure 21:
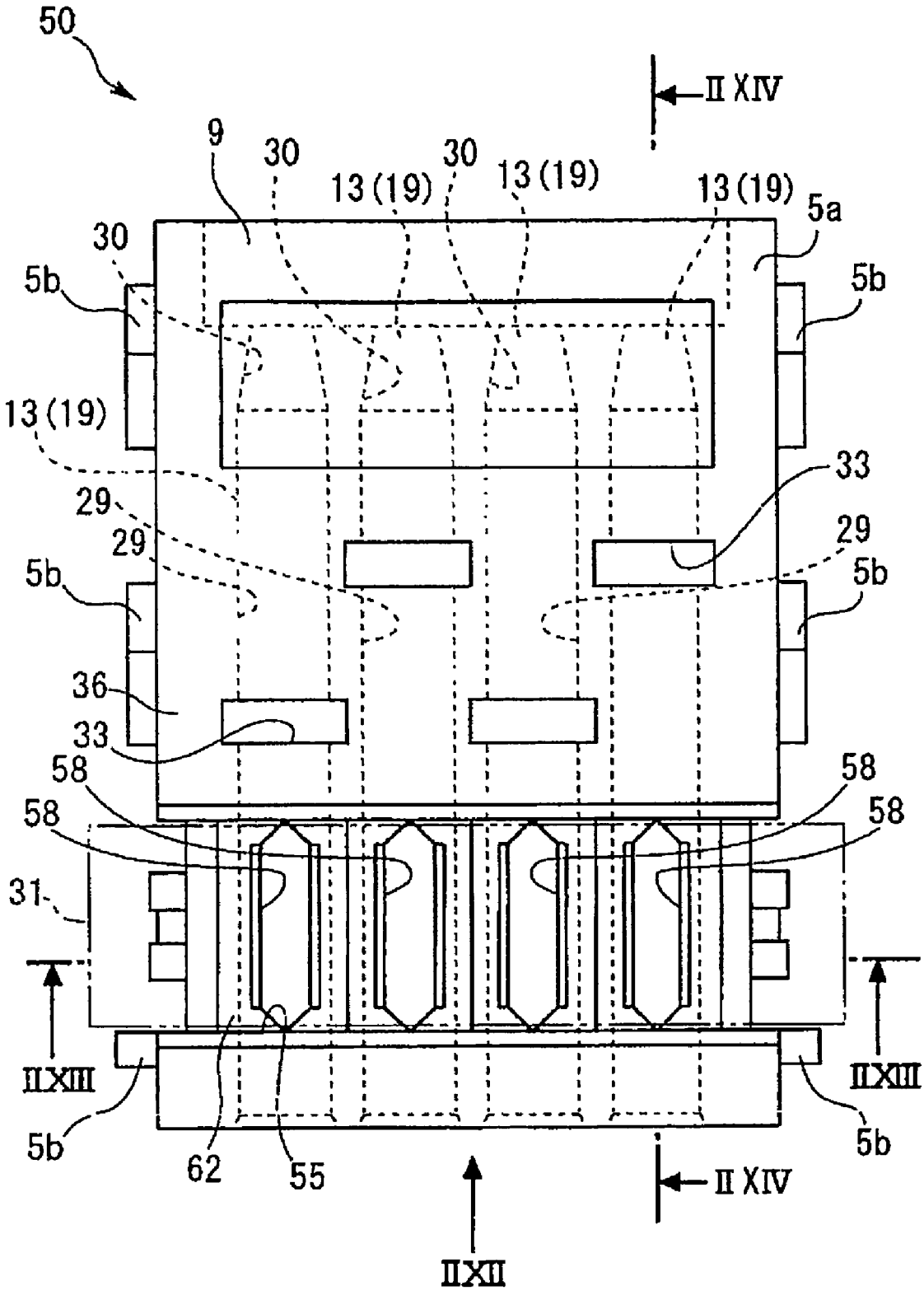
FIG. 21 is a plan view of a cover housing according to a second embodiment of the present invention, which is a view corresponding to FIG. 17.
Figure 22:
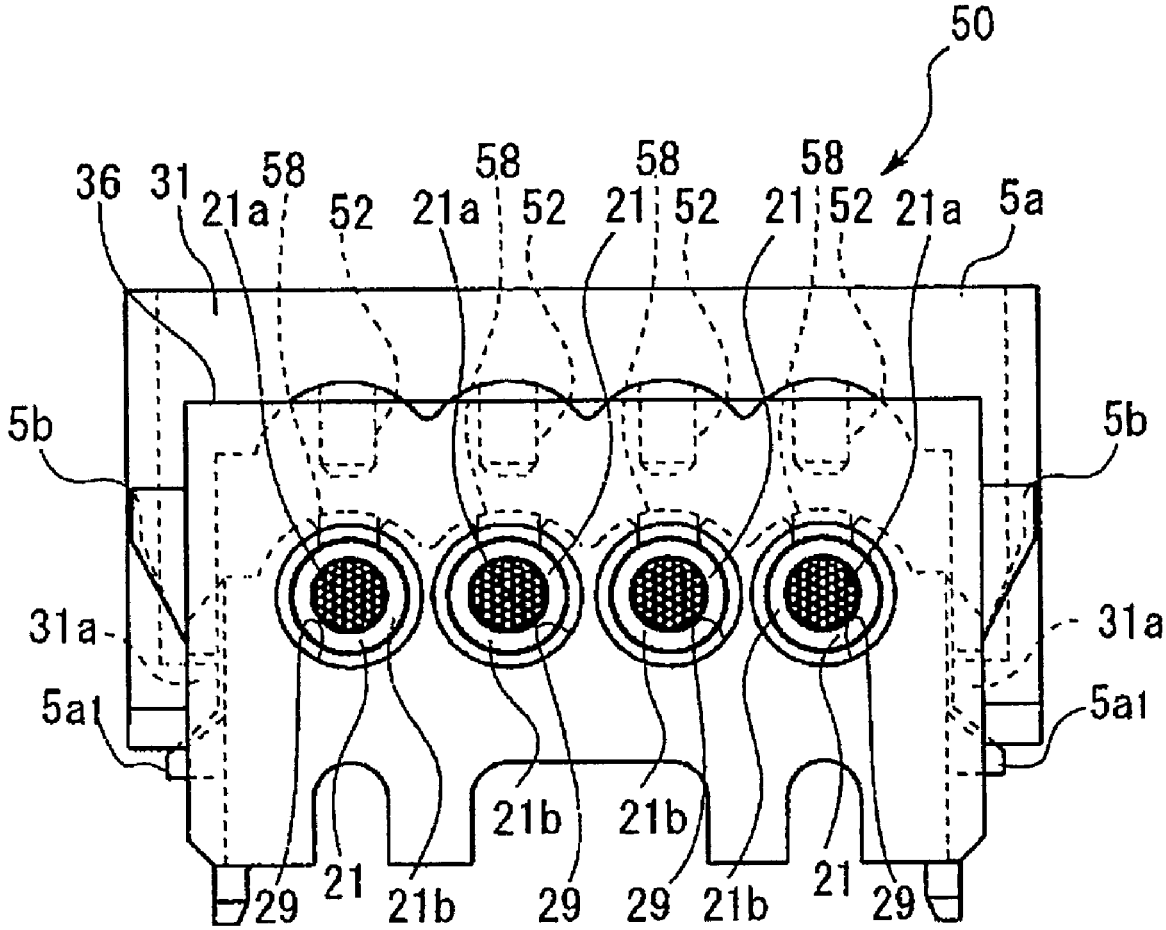
FIG. 22 is a view as seen from the direction of arrow IIXII in FIG. 21, which is a view corresponding to FIG. 19.

In more detail, as can be seen from FIGS. 21 & 22, at the crossing part between the opening 5 where the holder 31 is disposed and the wire insertion hole 29 is covered with a protective guide plate 62 so as to protect the wire 21. Thus, the protective guide plate 62 may also be referred to as a cover portion for the wire 21. In the protective guide plate 62, plural (four in this embodiment) guide slits 58 each having a diamond shape obtained by tapering both ends of an elongate rectangle are formed in the protective guide plate 62.

Figure 23:
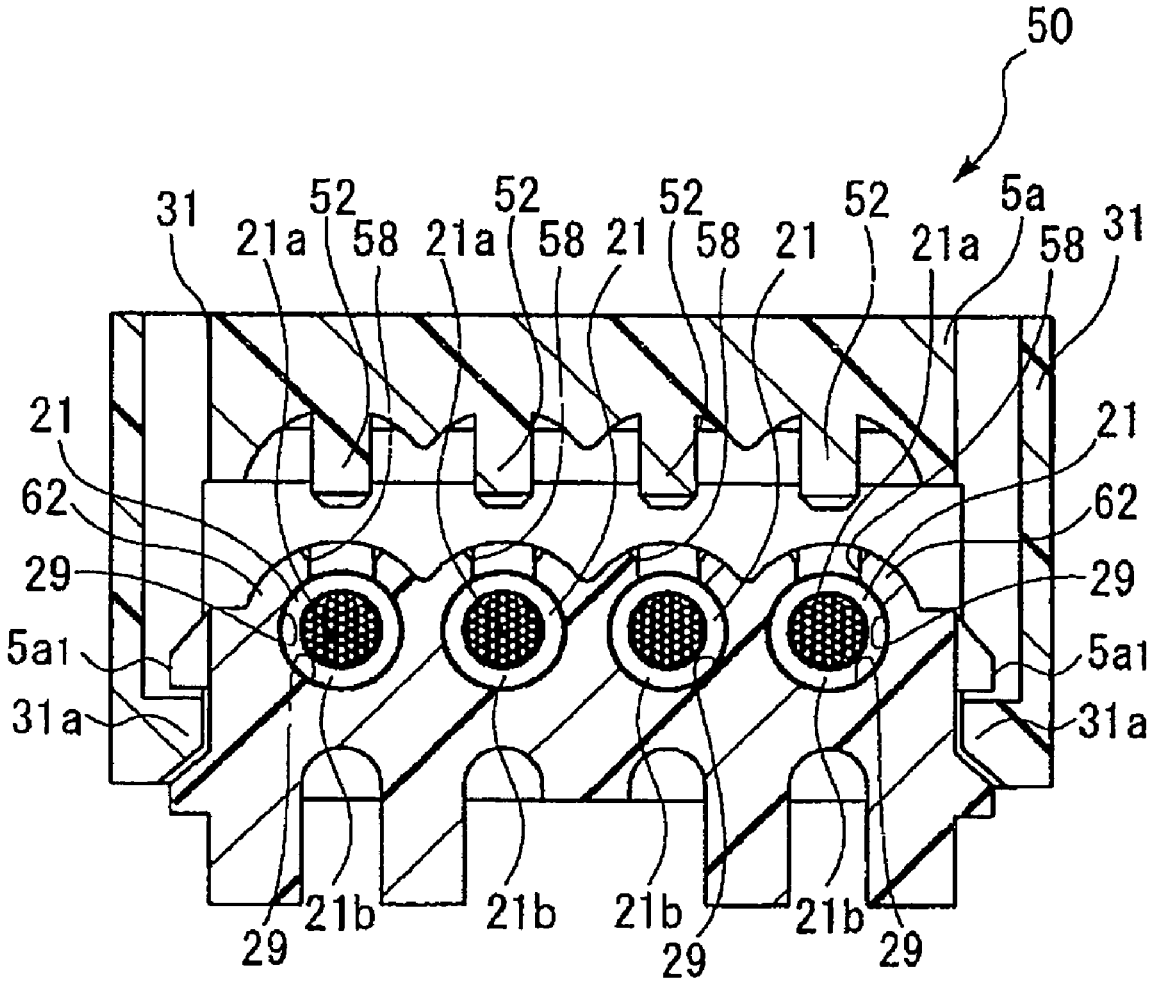
FIG. 23 is a sectional view taken along the line IIXIII—IIXIII of FIG. 21, which is a view corresponding to FIG. 18.
Figure 24:
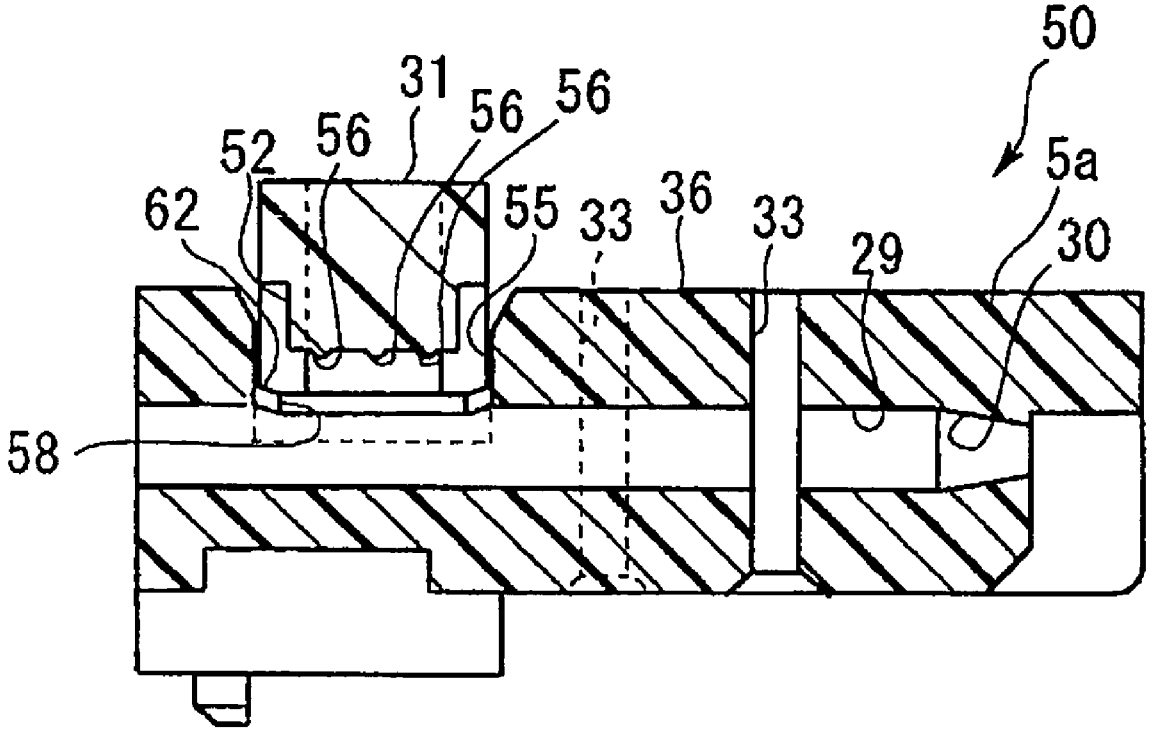
FIG. 24 is a sectional view taken along the line IIXIV—IIXIV of FIG. 21, which is a view showing a state in which the wire holder is added.

As illustrated in cross section in FIGS. 22 & 23, the protective guide plate 62 is shaped as a series of continuous arches. The guide slits 58 are individually formed with setting the respective apexes of those arch portions as centers. On the other hand, as can be seen in FIG. 23, the guide projection 52 is formed as a rectangle in cross section which is somewhat thinner than the guide slit 58.

This arrangement is to prevent the guide projection 52 from interfering with the guide slit 58. Further, plural protrusions 56 (FIG. 24) are formed on the leading end surface of the guide projection 52, in order to provide stability by those protrusions 56 when the electric wire 21 is pressed and to enable electric wire retention capable of withstanding the tensile force of the wire 21 (that is, the function as a strain relief).

With the above-constructed connector according to the second embodiment of the present invention as well, there can be attained basically the same effects as those of the connector according to the first embodiment. Concerning an operational effect unique to the present embodiment, the protective guide plate 62 is provided at the crossing part between the opening 55 and the wire insertion hole 29, and the guide slit 58 is formed in the protective guide plate 62. Thus, when the guide projection 52 is inserted into the guide slit 58 formed in the protective guide plate 62 so that the wire 21 is pressed on by the guide projection 52 and the guide projection 52 thus functions as the wire holder, since the guide slit 58 is closed by the guide projection 52, the insulation material of the wire 21 is not easily pushed outward off the wire insertion hole 29, which is a feature advantageous in maintaining the normal position of the wire 21.

As has been described above, according to the present invention, the wire is inserted into the wire insertion hole of the cover housing, thereby ensuring that the wire assumes a normal position in relation to the IDT terminal when the cover housing is incorporated into the base housing. Further, since the wire is supported firmly by the wire holder, the normal position of the wire is maintained as it is, making it possible to bring the wire into IDT contact with the IDT contact edge. Therefore, since the wire is not forcibly pushed into the slot of the IDT terminal from its non-normal position, abnormal deformation or the like does not occur with respect to the inner conductor of the wire. As a result, excessive concentration of stress does not take place in the conductor, thereby making it possible to suppress a degradation of the conductor or a variation in the resistance value and also prevent an increase in the resistance value due to a decrease in the sectional area resulting from excessive pressing.

The invention claimed is:

1. An IDT connector, comprising:

a base housing having a plural of conductive insulation displacement terminals to which a plurality of wires applied with outer insulation are press-fitted;

a cover housing engageable with the base housing, the cover housing having a plurality of guide holes which the wires therein;

a wire holder for holding said wires for insertion into the guide holes, wherein said cover housing has wire normal-position fixing means for fixing said wires in a normal position within said guide holes with respect to a connection direction of said wires, the wire normal-position fixing means including tapered bores that form inner surfaces of said guide holes, diameters of said tapered bores gradually decreasing relative to diameters of said wires and, wherein said wires are fixed a normal position in said cover housing by said tapered bores and are brought into contact with said insulation displacement terminals when said cover housing is engaged with said base housing.

2. An IDT connector according to claim 1, further including a protective guide plate for protecting said wires, the protective guide plate being disposed is provided in an area of said cover housing, where the wire holder that is descended crosses said guide holes, and said protective guide plate covering said wires.

3. An IDT connector according to claim 1, wherein a plurality of said insulation displacement terminals are provided in said base housing such that adjacent terminals are staggered relative to each other in a zigzag pattern with respect to a connection direction of said wires.

4. An IDT connector according to claim 1, wherein said wire holder is attached to said cover housing, in a manner such that said wire holder is capable of being displaced to a position where said wire holder does not interfere with said wires to be inserted in said guide holes.

5. An IDT connector according to claim 4, further including displacement guiding portions that guide said wire holder during engagement of said cover housing with said base housing so that said wires held thereby are displaced in a parallel fashion.

* * * * *